US005328339A

United States Patent [19]

Jong

[11] Patent Number: 5,328,339

[45] Date of Patent: Jul. 12, 1994

[54] PUMP DRIVEN BY AIR PRESSURE

[76] Inventor: Huey-Jeng Jong, 28-5, Sheh Dou Road, Zen Yea Village, Sheh Tou Shian, Jang Hwa Hsien, Taiwan

[21] Appl. No.: 126,622

[22] Filed: Sep. 27, 1993

[51] Int. Cl.[5] ..... F04B 17/00

[52] U.S. Cl. ..... 417/403

[58] Field of Search ..... 417/403, 404

[56] References Cited

U.S. PATENT DOCUMENTS 2,012,839 8/1935 Turner ..... 417/403 X
2,935,953 5/1960 Coberly ..... 417/403 X
5,173,036 12/1992 Fladby ..... 417/403

*Primary Examiner*—Richard E. Gluck
*Attorney, Agent, or Firm*—Larson and Taylor

[57] ABSTRACT

A pump driven by air pressure comprising an air cylinder, a piston in the cylinder to move up and down, an upper cylinder cap and a lower cylinder cap, a connector combined with a tubular projection of the upper cap for gas to flow through an interior of the connector, a valve base connected with a tubular projection of the lower cap, the piston moving up and down to move a tubular rod for changing gas flowing route and then forcing the piston to move in a reversed direction for pumping in liquid.

1 Claim, 2 Drawing Sheets

PUMP DRIVEN BY AIR PRESSURE

BACKGROUND OF THE INVENTION

A conventional water pump is known to have an eccentric rod fixed on a shaft of a motor, and the eccentric rod is connected with a pivotal shaft provided with a sidewise piston rod having a piston, which are moved to and fro in a pressure cylinder by the motor so as to pump in and out gas in the cylinder.

SUMMARY OF THE INVENTION

The object of this invention is to provide a pump driven by air pressure.

The main feature of this invention is that two pistons—one large and the other small—are utilized to alter flowing direction of high pressure gas to attain the object of pumping in liquid.

BRIEF DESCRIPTION OF DRAWINGS

This invention will now be described in detail with reference to accompanying drawings wherein.

DETAILED DESCRIPTION OF THE INVENTION

Figure 1:
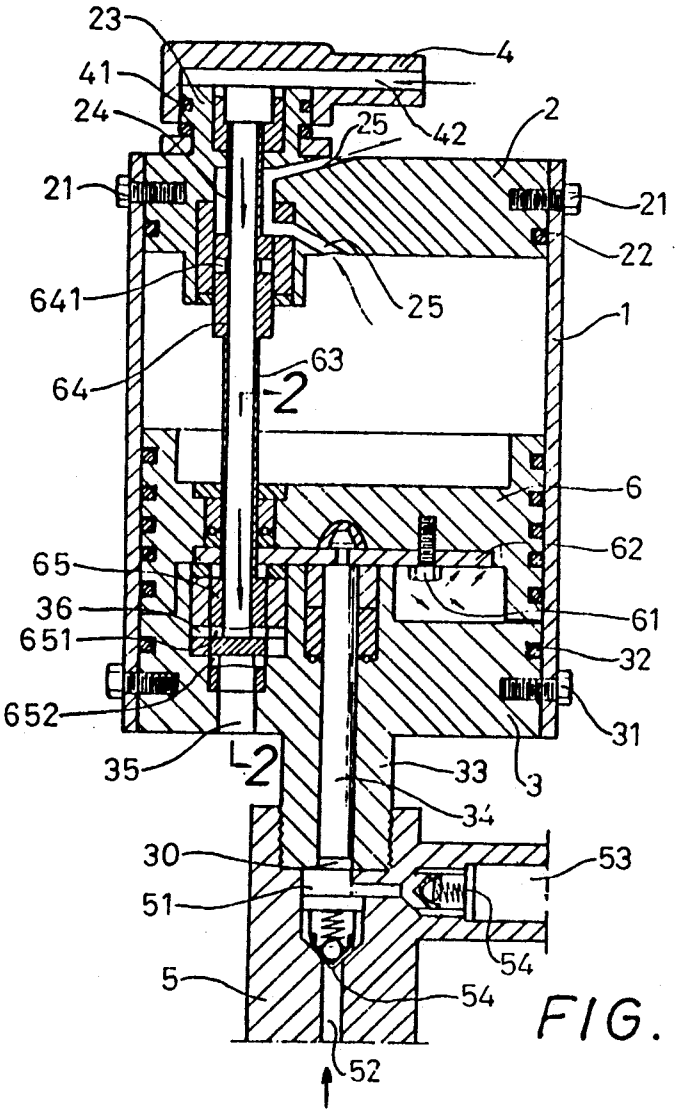
FIG. 1 is a front cross-sectional view of a pump driven by air pressure in the present invention.

A pump driven by air pressure in the present invention, as shown in FIG. 1, comprises a cylinder 1, an upper cylinder cap 2, a lower cylinder cap 3, a joint 4 connected with the upper cylinder cap 2, a valve base 5 connected with the lower cylinder cap 3, a piston 6 to move in the cylinder 1 so as to open or close a passageway of the valve base 5 for sucking in liquid.

The upper cylinder cap 2 is fixed with an upper portion of the cylinder 1 by means of a locking member 21 such as bolts or screws, and an annular anti-leak gasket 22 is fixed around the upper cylinder cap and contacts with an inner wall of the cylinder 1 for preventing leakage. The upper cylinder cap 2 also has an upper tubular projection 23 to connect with the joint 4, and an anti-leak gasket 41 is provided between the projection 23 and the joint 4 for preventing leakage. A valve hole or chamber 24 is provided in the upper cylinder cap 2, communicating with the hole of the tubular projection 23. A tubular rod 63 is provided to move up and down in the hole of the projection 23. Two air passageways 25 are provided in the cap 2, communicating with the valve hole 24, with one (exhaust) of the two passageways 25 extending slantingly upward to an upper surface and with the other (feed) of the two passageways 25 extending slantingly down to a lower surface so that gas in the cylinder 1 may flow through the passageways 25 out to open air when the tubular rod 63 moves up.

The lower cylinder cap 3 is fixed with an lower portion of the cylinder 1 with locking members 31 such as bolts or screws, and an annular anti-leak gasket 32 is provided around the cap 3 to prevent leakage. The lower cap 3 has an tubular portion 33 extending down and having an outer thread to engage the valve base 5, and a vertical hole 30 for a piston rod 34 to mvoe up and down therein. A piston 6 is provided in the cylinder 1, and connected with an upper end of the piston rod 34, moving the rod 34 up and down quickly in the hole 30 so as to open or close a passageway in the valve base for pumping in liquid. The lower cap 3 is also provided with a vertical (through) hole 35 for the tubular rod 63 to extend therein, and with a passageway 36 communicating with the bottom (exhaust) end of the vertical hole 35 for connecting open air with the interior of the cylinder 1.

The connector 4 is combined with the tubular projection 23 of the upper cylinder cap 2, and the anti-leak gasket 41 is used to prevent leakage between the both. The connector 4 has an air passageway 42 for high pressured gas to flow in so that the high pressure gas can flow in an interior of the tubular rod 63 and then through the lower passageway 25 to push the piston 6 down.

The valve base 5 is threadably combined with the tubular projection 33 of the lower cylinder cap 3, having a vertical valve hole or working chamber 51 communicating with the hole 30 of the lower cylinder cap 3 for moving up the piston rod 34 so as to suck in liquid through the hole 51. The valve hole 51 communicates with a vertical liquid inlet hole 52 and a lateral liquid outlet hole 53, and the two holes 52, 53 respectively have a valve 54, functioning to guide liquid to flow through the inlet hole 52 and out of the outlet hole 53.

The piston 6 is positioned in the cylinder 1, having a small piston 62 fixed on a bottom surface with a bolt 61, and the piston rod 34 is fixed with both the piston 6 and the small piston 62, so the piston rod 34 is moved up and down in the hole 30 by the piston 6 and the small piston 62. The piston 6 and the small piston 62 have a vertical hole for the tubular rod 63 to fit and move therein, while the piston rod 63 has an upper valve 64 and a lower valve 65 of large diameter. The upper valve 64 fits and moves in the valve hole 24 of the upper cap 2, having a sideway guide hole 641 communicating with the interior of the tubular rod 63 by facing the lower passageway 25 or the hole 641 not communicating with the lower passageway 25 by moving away with the valve 64. The lower valve 65 is connected with a lower end of the piston rod 63, and moves in the vertical hole 35 of the lower cap 3, having an upper sideway passageway 651 and a lower sideway passageway 652. Either the upper passageway 651 or the lower passageway 652 can communicate with the passageway 36 of the lower cap 3.

Figure 2:
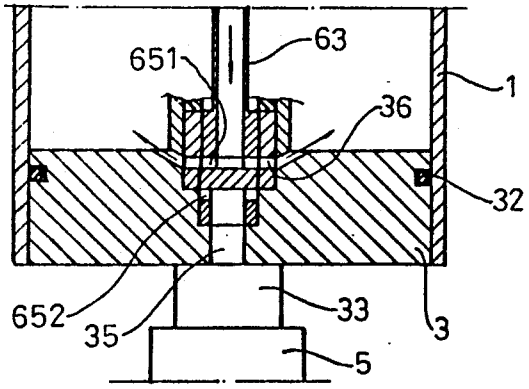
FIG. 2 is a cross-sectional view taken along line 2—2 of FIG. 1.

Next, how the present invention funcitons is to be described. As show in FIG. 1, when high pressure gas is made to flow into an air passageway 42 of the connector 4, it moves down through the interior of the tubular rod 63, then through the upper passageway 651 of the lower valve 65 and the passageway 36, as shown in FIG. 2, and into the cylinder 1. Next, the gas pushes the lower side of the piston 6 so that the piston 6 is lifted up, forcing the gas in the upper side of the piston 6 to flow out of the upper passageway 25.

Figure 4:
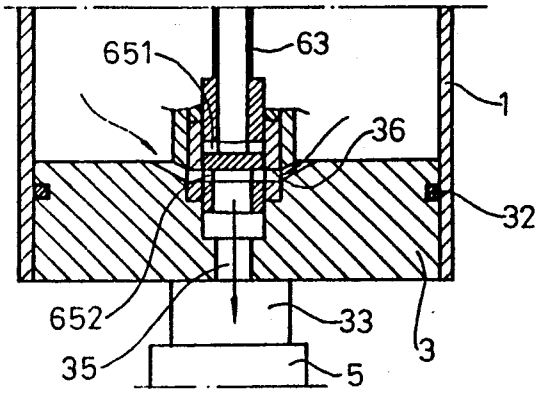
FIG. 4 is a cross-sectional view taken along line 4—4 of FIG. 3.
Figure 3:
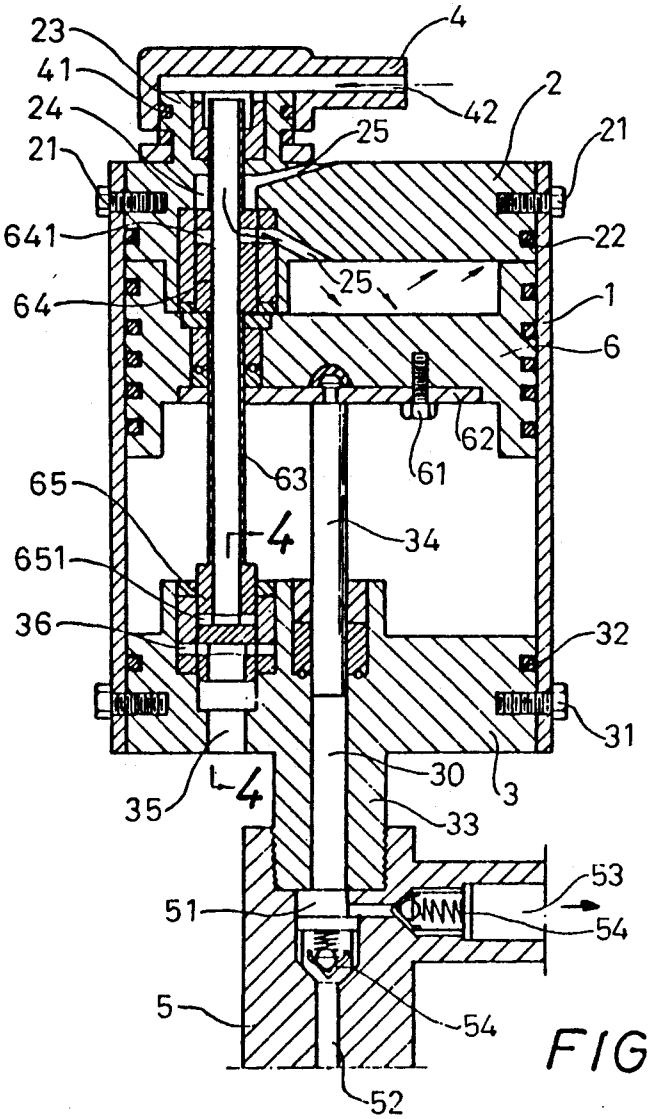
FIG. 3 is a cross-sectional view of the pump driven by air pressure in the present invention, showing an action of a piston in a cylinder.

As shown in FIG. 3, when the piston is lifted up, the piston 6 can lift up the piston rod 34 at the same time, and consequently, the inlet hole 52 of the valve 5 is opened, letting liquid drawn in therethrough until the piston 6 reaches a certain height to touch with the upper valve 64. Then the upper valve 64 is also lifted up, permitting the side guide hole 641 to communicate with the lower passageway 25, and the upper passageway 651 of the lower valve 65 separates from the passageway 36, but the lower passageway 25 communicates with the passageway 36. Therefore, the gas coming through the passageway 42 of the connector 4 flows through the side guide hole 641, through the lower passageway 25 and into the interior of the cylinder and on the upper side of the piston 6 so that the piston 6 is pushed down. At this time, the gas in the lower side of the piston 6, as shown in FIG. 4, flows through the passageway 36, the lower passageway 652 and then through the vertical hole 35 to open air. When the piston 6 reaches the bottom, it pushes down the lower valve 65 of the piston rod 63, so the upper passageway 651 communicates with the passageway 36 again, recovering the position shown in FIG. 1. The piston rod 34 also moves down with the moving-down piston 6, forcing the valve 54 of the inlet hole 52 shut and liquid exhausted from the outlet hole 53.

The main feature of the present invention is that high pressure gas is utilized to flow continuously in the cylinder 1 to push the piston 6 up together with the piston rod 34 for sucking liquid in, and then contacts and moves up the tubular rod 63, altering the passing route of the gas so as to reverse the moving direction of the piston 6, forcing the piston rod to exhaust the liquid out. And the above mentioned operation is repeated to attain the function of pumping liquid in and out of valve base 5.

What is claimed is:

1. A pump driven by air pressure for pumping a liquid comprising:

an elongate cylinder, a piston which moves reciprocally up and down between two ends of said cylinder, and a piston rod attached longitudinally to said piston for movement therewith;

an upper cylinder cap fixed to one end of said cylinder, said upper cylinder having (a) an upper through hole in communication with the air pressure, (b) a valve chamber located about said upper through hole, (c) an upper exhaust passageway which communicates said valve chamber with ambient atmosphere, and (d) a lower feed passageway which communicates said valve chamber with an interior of said cylinder below said upper cylinder cap;

a lower cylinder cap fixed with the other end of said cylinder, said lower cylinder having (a) a lower piston rod hole in which said piston rod reciprocates, (b) a lower through hole, (c) an upper feed passageway which communicates said lower through hole to an interior of said cylinder above said lower cylinder cap and (d) a lower exhaust passageway which communicates said lower through hole with ambient atmosphere;

a tubular rod which extends between said upper through hole and said lower through hole and slidingly through said piston, said tubular rod being movable between a first position and a second position and including an upper end in communication with the air pressure;

an upper valve member attached to said tubular rod and located in said valve chamber so that in the first position an upper aperture in said tubular rod communicates the air pressure in said tubular rod through said valve chamber with said lower feed passageway to cause said piston to move away from said upper cap while communication through said valve chamber between said lower feed passageway and said upper exhaust passageway is blocked and so that in the second position communication is established through said valve passageway between said lower intake passageway and said upper exhaust passageway while said upper aperture is blocked, and said upper valve member including a portion which is engaged by said piston as said piston moves toward said upper valve member to move said tubular rod from the second position to the first position;

a lower valve member attached to said tubular rod and located in said lower through hole so that in the first position a lower blocked end of said tubular rod does not block communication between said upper feed passageway and said lower exhaust passageway and so that in the second position a lower aperture in said tubular rod above said blocked end communicates the air pressure in said tubular rod to said upper feed passageway to move said piston away from said lower cap while communication between said upper feed passageway and said lower exhaust passageway is blocked by said lower blocked end, and said lower valve member including a portion which is engaged by said piston as said piston moves toward said lower valve member to move said tubular rod from the first position to the second position; and a valve base attached to said lower cylinder cap, said valve base having (a) a working chamber in communication with said lower piston rod hole, (b) a liquid inlet hole, (c) a liquid outlet hole, (d) an inlet one-way valve provided between said liquid inlet hole and said chamber, and (e) an outlet one-way valve provided between said chamber and said liquid outlet hole such that (a) as said piston rod moves away from said lower cap with said piston, liquid is drawn into said chamber through said liquid inlet hole and said inlet one-way valve and (b) as said piston rod moves toward said lower cap with said piston, liquid in said chamber is expelled therefrom through said outlet one-way valve and said liquid outlet hole.

* * * * *